US006680719B2

(12) United States Patent
Tsuchida et al.

(10) Patent No.: US 6,680,719 B2
(45) **Date of Patent: *Jan. 20, 2004**

(54) LIGHT EMITTING DISPLAY DEVICE IN WHICH LIGHT EMITTING ELEMENTS ARE SEQUENTIALLY CONNECTED TO A FIRST DRIVE SOURCE AND A SECOND DRIVE SOURCE DURING EMISSION OF LIGHT AND A METHOD THEREFORE

(75) Inventors: Masami Tsuchida, Saitama (JP); Shinichi Ishizuka, Saitama (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/224,330

(22) Filed: Aug. 21, 2002

(65) Prior Publication Data

US 2002/0196215 A1 Dec. 26, 2002

Related U.S. Application Data

(63) Continuation of application No. 09/247,825, filed on Feb. 11, 1999, now Pat. No. 6,473,064.

(30) Foreign Application Priority Data

Feb. 13, 1998 (JP) ..... P. 10-048653

(51) Int. Cl.[7] ..... G09G 3/32; G09G 3/10

(52) U.S. Cl. ..... 345/82; 315/169.3

(58) Field of Search ..... 345/44, 45, 46, 345/55, 76, 77, 80, 82, 204, 211, 213, 214, 215; 315/169.3; 348/800

(56) References Cited

U.S. PATENT DOCUMENTS

| | | | | | |
|---|---|---|---|---|---|
| 5,719,589 | A | * | 2/1998 | Norman et al. | 345/82 |
| 5,723,950 | A | * | 3/1998 | Wei et al. | 315/169.3 |
| 5,828,181 | A | * | 10/1998 | Okuda | 315/169.3 |
| 5,844,368 | A | * | 12/1998 | Okuda et al. | 315/169.3 |
| 5,923,309 | A | * | 7/1999 | Ishizuka et al. | 345/82 |
| 6,072,477 | A | * | 6/2000 | Ueno | 345/211 |
| 6,121,943 | A | * | 9/2000 | Nishioka et al. | 345/76 |
| 6,339,415 | B2 | * | 1/2002 | Ishizuka | 345/76 |
| 6,351,255 | B1 | * | 2/2002 | Ishizuka et al. | 345/77 |
| 6,473,064 | B1 | * | 10/2002 | Tsuchida et al. | 345/82 |

* cited by examiner

*Primary Examiner*—Chanh Nguyen
*Assistant Examiner*—Paul A. Bell
(74) *Attorney, Agent, or Firm*—Sughrue Mion, PLLC

(57) ABSTRACT

A light emitting display device having a plurality of light emitting elements connected to intersecting points of a plurality of anode lines and cathode lines arranged in a matrix. Either one of the anode lines and the cathode lines are used as scanning lines, and the others are used as driving lines. While one of the scanning lines is scanned during a scanning period, a driving source is synchronously connected to one of the driving lines so that a light emitting element connected to an intersecting point of the one scanning line and the one driving line is caused to emit light. Immediately after the scanning period of the one scanning line is started, a first driving source is connected to the one driving line, and subsequently, in exchange for the first driving source, a second driving source is connected to the one driving line.

20 Claims, 7 Drawing Sheets

LIGHT EMITTING DISPLAY DEVICE IN WHICH LIGHT EMITTING ELEMENTS ARE SEQUENTIALLY CONNECTED TO A FIRST DRIVE SOURCE AND A SECOND DRIVE SOURCE DURING EMISSION OF LIGHT AND A METHOD THEREFORE

This is a continuation of application Ser. No. 09/247,825 filed Feb. 11, 1999 now U.S. Pat. No. 6,473,064; the disclosure of which is incorporated herein by reference.

BACKGROUND OF THE INVENTION

1. Field of the Invention

The present invention relates to a light emitting display device having light emitting elements, and further relates to a method for driving a light emitting element when an electric field is applied thereto.

2. Description of the Related Art

Due to recent demand for high definition images, a self light-emitting type of organic electroluminescent light emitting element (hereinafter referred to as "light emitting element") has become a focus of attention. Due to advancements in organic layer materials, this light emitting element is highly efficient and has long life.

Referring to FIG. 7, a light emitting element E is composed of a metallic electrode 101 (a cathode), a transparent electrode 102 (an anode), an organic compound that is stacked between the electrodes 101 and 102, and a glass substrate 105 arranged outside the transparent electrode 102. The organic compound consists of an organic fluorescent thin film 103 and an organic hole transporting layer 104.

In a light emitting element having the configuration of FIG. 7, an exciter is generated by a recombination between an electron and a hole. The electron is generated in the metallic electrode 101 by a driving source 106, and the hole is from the transparent electrode 102. When the exciter is discharged and deactivated, light is emitted. The emitted light is externally released through the transparent electrode 102 and the glass substrate 105.

The light emitting element E, in which electrodes and organic fluorescent material are stacked, has a parasitic capacitance in its electric-equivalent circuit shown in FIG. 8. In this circuit, reference numeral 107 denotes a light emitting body of a constant voltage element, reference numeral 108 denotes an internal resistance, and reference numeral 109 denotes a parasitic capacitance. The parasitic capacitance 109 is connected in parallel with the light emitting body 107 and internal resistance 108.

FIG. 9 shows a variation in voltage applied to the light emitting element E when driven during a scanning period using a constant current driving technique. The ordinate indicates a voltage applied across the light emitting element E, and the abscissa indicates time. Reference numeral 110 denotes a scanning time, and reference numeral 111 denotes a charging time of the parasitic capacitance 109 of the light emitting element E. Reference symbol Vf denotes a forward voltage during maximum light emission, which depends on the static characteristic of the light emitting body 107.

As can be seen in FIG. 9, after the start of the scanning period, the voltage applied to the light emitting element E does not reach vf immediately. The delay is due to the current supplied from the driving source initially being consumed to charge the parasitic capacitance 109. The light emitted by the light emitting element E is proportional to the driving current. While the light emitting element E emits light with stable brightness after the parasitic capacitance is charged, the brightness during the initial period is not sufficient. The adverse result is that the brightness varies during the scanning period, and the average brightness over the entire scanning period is reduced.

SUMMARY OF THE INVENTION

In view of the problem described above, it is an object of the present invention to provide a light emitting display device which requires a shorter time to emit light with a desired instantaneous brightness and has less variation in instantaneous brightness during a scanning period.

The present invention includes a light emitting display device having a plurality of light emitting elements, comprising first and second driving sources, a connection selector, and a controller. The first and second driving sources are connectable to the light emitting elements. The connection selector selects one of the first and the second driving sources, and connects the selected driving source to the light emitting elements. The controller controls the connection selector to connect the first driving source to the light emitting elements, and subsequently, in exchange for the first driving source, connects the second driving source to the light emitting elements. A driving current supplied to the light emitting elements by the first driving source is larger than a driving current supplied to the light emitting elements by the second driving source.

The first driving source may be a constant voltage source, and the second driving source may be a constant current source. Alternatively, each of the first and the second driving sources may be constant current sources.

The invention also includes a method for driving a light emitting display device having a plurality of light emitting elements. First and second driving sources, which are connectable to the light emitting elements, are provided. Driving currents are supplied to the light emitting elements, wherein a driving current supplied by the first driving source is larger than a driving current supplied by the second driving source. The first driving source is first connected to the light emitting elements. Subsequently and in exchange for the first driving source, the second driving source is connected to the light emitting elements.

The invention further includes a method for driving a light emitting display device having light emitting elements connected to intersecting points of a plurality of anode lines and cathode lines arranged in a matrix. Either one of the anode lines and the cathode lines are used as scanning lines, while the others are used as driving lines. While one of the scanning lines is scanned during a scanning period, a driving source is synchronously connected to one of the driving lines so that a light emitting element connected to an intersecting point of the one scanning line and the one driving line is caused to emit light. Immediately after the scanning period of the one scanning line is started, a first driving source is connected to the one driving line. Subsequently, in exchange for the first driving source, a second driving source is connected to the one driving line.

In order to drive a light emitting element during a scanning period, the parasitic capacitance of a light emitting element can be charged at a high speed by a first driving source and thereafter the light emitting element can be driven with constant instantaneous brightness. Therefore, the time elapsing until the light emitting element emits light with desired instantaneous brightness can be shortened and variation in the instantaneous brightness within a scanning period can be reduced.

DETAILED DESCRIPTION OF THE INVENTION

Figure 1:
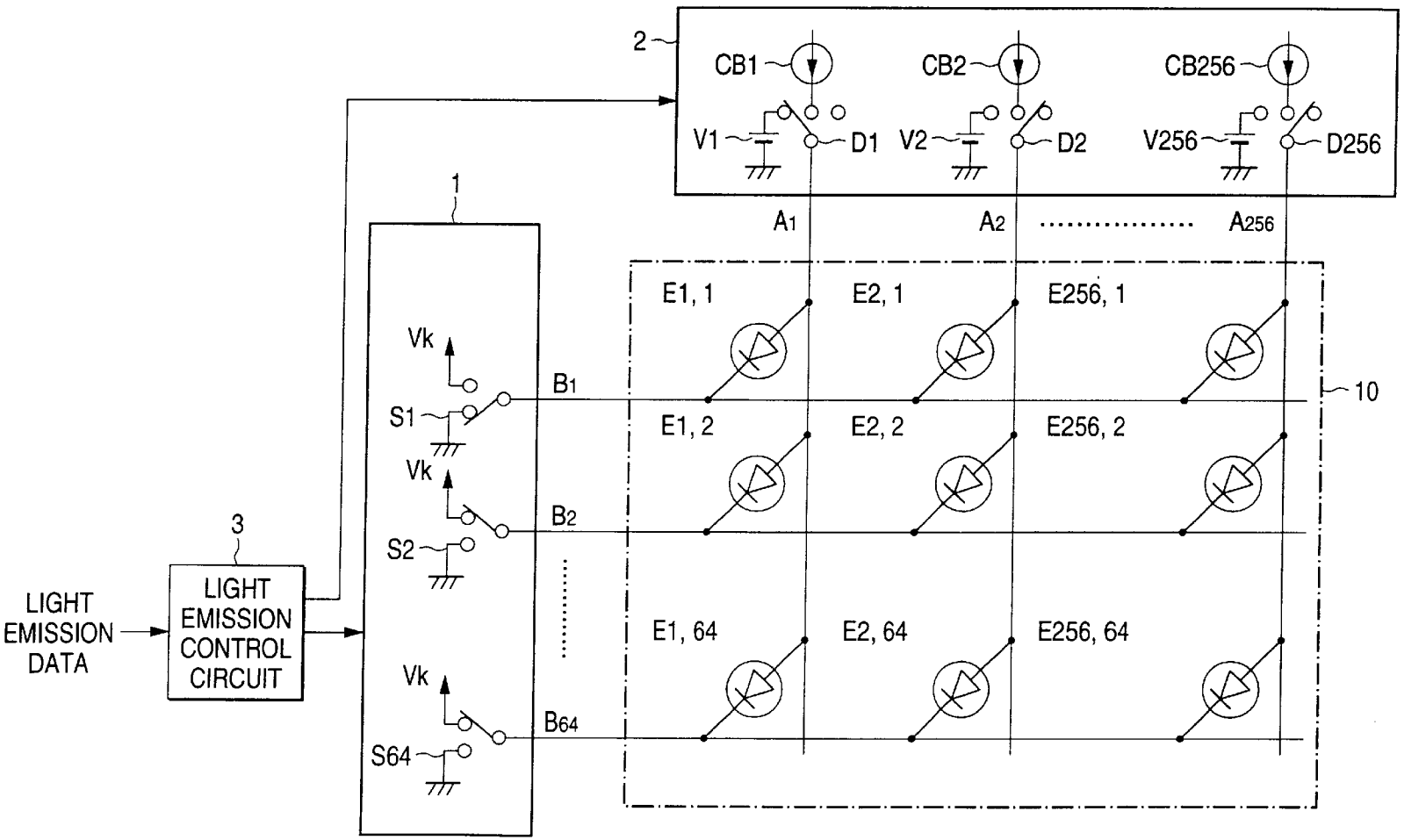
FIG. 1 is a block diagram of a light emitting display panel driving device used in a method of driving a light emitting element according to a first embodiment of the present invention.

FIG. 1 shows a block diagram of a light emitting display panel driving device used in a method of driving a light emitting element according to a first embodiment of the present invention. The light emitting display device includes a display panel 10, a cathode line scanning circuit 1, an anode line driving circuit 2, and a light emission control circuit 3.

The display panel 10 includes anode lines A1 to A256, cathode lines B1 to B64, and light emitting elements E1, 1 to E256, 64. The anode lines A1 to A256 are driving lines arranged to be parallel to one another. The cathode lines B1 to B64 are scanning lines arranged to be orthogonal to the cathode lines. The light emitting elements E1, 1 to E256, 64 are arranged at and connected to the respective intersecting points of the anode lines and cathode lines.

The cathode line scanning circuit 1 includes scanning switches S1 to S64 for scanning the cathode lines B1 to B64. One terminal of each of these scanning switches S1 to S64 is connected to a reverse bias voltage Vk, which is a constant current; the other terminal is connected to ground potential. Thus, the cathode lines B1 to B64 can be connected to either one of the reverse bias voltage Vk and ground potential.

It should be noted that the reverse bias voltage Vk is set to be larger than the voltage of a constant voltage source V1 to V256 and of a constant current source CB1 to CB256, to be described later.

The anode line driving circuit 2 includes constant voltage sources V1 to V256, a charger, constant current sources CB1 to CB256, and driving switches D1 to D256. The constant voltage sources V1 to V256 are each a first driving source and a charger for charging the parasitic capacitance of a light emitting element. The constant current sources CB1 to CB256 are each a second driving source. The driving switches D1 to D256 each switch an anode line to be driven.

The driving switches D1 to D256 are each constructed as a three-point exchanging switch. The first contact points of the switches are open, the second contact points thereof are connected to the constant current sources CB1 to CB256, respectively, and the third contact points thereof are connected to the constant voltage sources V1 to V256, respectively.

It should be noted that the magnitude of the voltage applied by the constant voltage source V1 to V256 is set to be substantially equal to the voltage across the respective light emitting element E1, 1 to E256, 64 when the element emits light with maximum instantaneous brightness.

The light emitting control circuit 3 controls the scanning switches S1 to S64 and driving switches D1 to D256 in accordance with inputted light emission data.

Figure 2A:
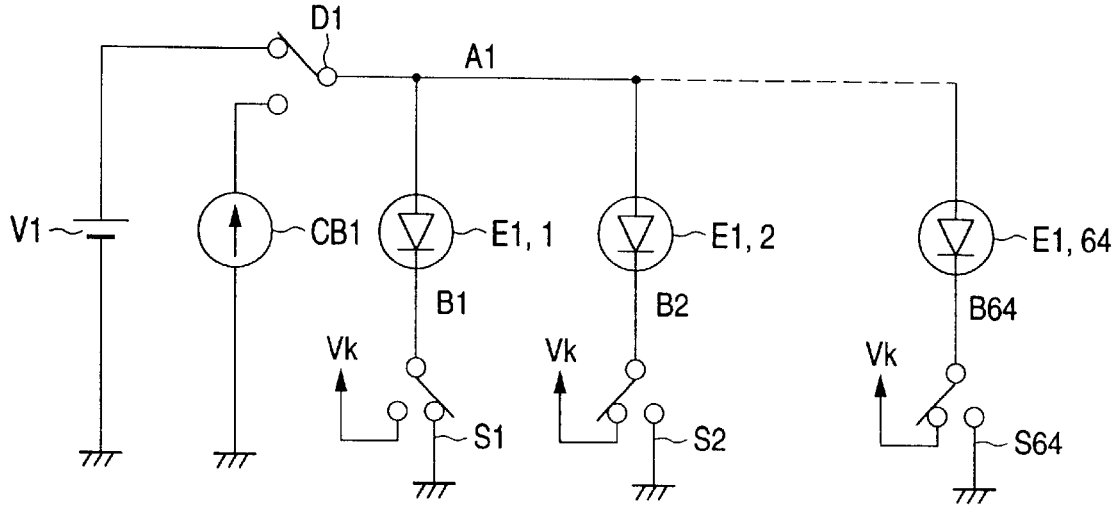
FIGS. 2A and 2B are partial circuit diagrams when anode line A1 is driven by the method of the first embodiment.
Figure 2B:
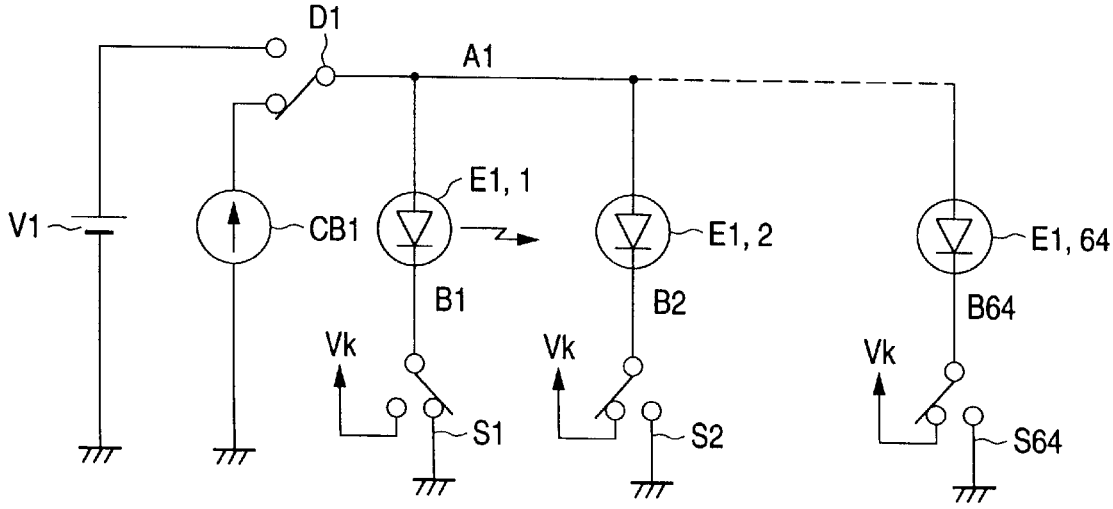

Referring to FIGS. 1, 2A and 2B, an explanation will be given of the operation of the first embodiment of the present invention. FIGS. 2A and 2B each show a partial circuit diagram relative to the anode line A1 of FIG. 1.

FIG. 1 shows the state in which the light emitting element E1, 1 is caused to emit light in such a manner that the cathode line B1 is scanned and the anode line A1 is driven. In this state, the cathode line B1 is connected to ground potential and the other cathode lines are connected to the reverse bias voltage Vk.

During the scanning period of the cathode line B1, the anode line A1 is first driven by being connected to the constant voltage source v1 (see FIG. 2A), and its connection is subsequently switched by the driving switch D1 to the constant current source CB1 (see FIG. 2B). During this scanning period of cathode line B1, the other cathode lines are not driven because they are connected to the reverse bias voltage Vk. Thus, the forward voltage (in the direction from the anode line to the cathode line) is applied across the light emitting element El, 1 so that the light emitting element E1, 1 emits light. Meanwhile, the other light emitting elements, across which the reverse voltage is applied, do not emit light.

When scanning of the cathode line B1 is completed, scanning is shifted to the cathode line B2 in accordance with the light emission control signal from the light emission control circuit 3. Scanning will be sequentially executed for the scanning lines.

In the above operation, the light emitting element E1, 1 is connected to the constant voltage source V1 at the moment the scanning period of the cathode B1 begins. Therefore, the voltage across the light emitting element E1, 1 instantaneously becomes substantially equal to the voltage when the light emitting element E1, 1 emits light with the maximum voltage. As a result, its parasitic capacitance is charged swiftly. This assures a longer period of time during which the light emitting element E1, 1 emits light with the maximum instantaneous brightness during the scanning period, thereby providing improved light-emitting brightness during the scanning period.

After the parasitic capacitance is charged, the connection is changed from the constant voltage source V1 to the constant current source CB1, with little change in brightness.

Figure 3:
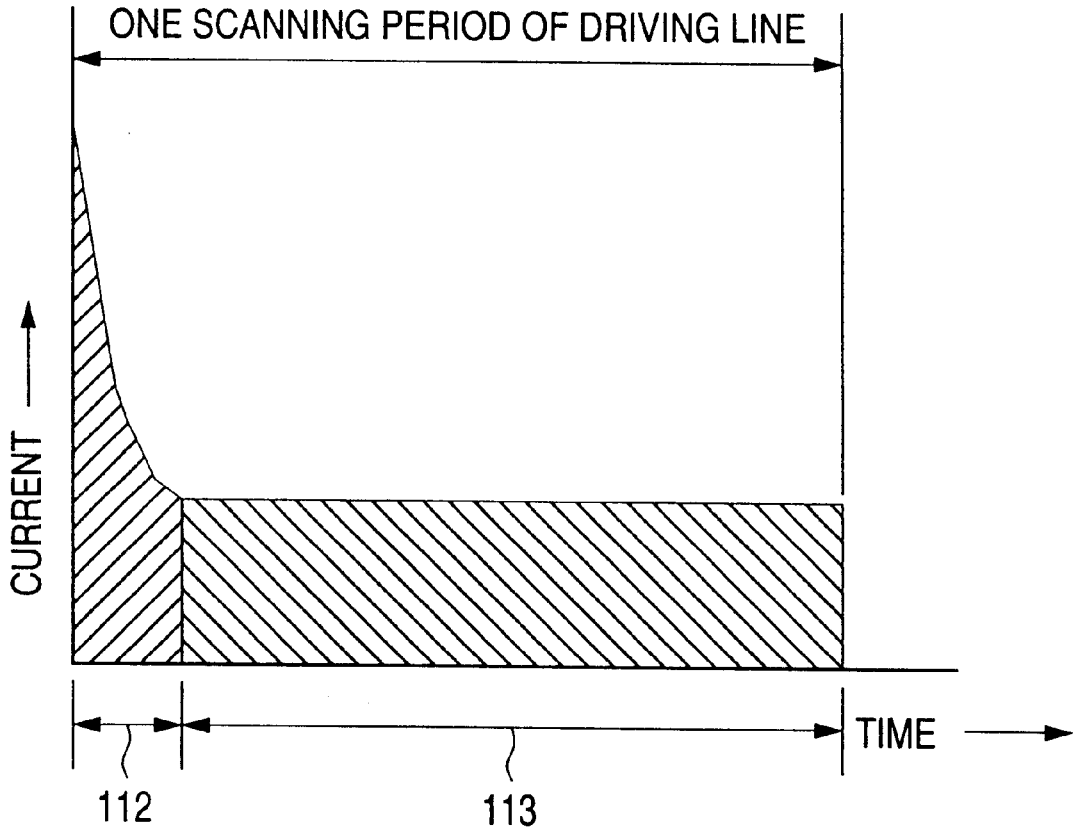
FIG. 3 is a graph showing a relationship between a supplied current and timing of a connection exchange from a constant voltage source to a constant current source by an anode line driving circuit.

FIG. 3 is a graph showing the relationship between the supplied current and the timing of the connection exchange from the constant voltage source to the constant current source by the anode line driving circuit 2. The ordinate indicates a current value supplied to the light emitting element, whereas the abscissa indicates the timing of the connection exchange from the constant voltage source to the constant current source.

Reference numeral 112 denotes a period during which the constant voltage source is connected to the light emitting element. As can be seen from the figure, when the constant voltage source is connected, a large current flows for a moment, so that the parasitic capacitance is charged swiftly. During the charging process however, the current value gradually decreases. Reference numeral 113 denotes the period during which the constant current source is connected to the light emitting element.

The connection is most preferably exchanged from the constant voltage source to the constant current source when the current supplied by the former becomes equal to that supplied by the latter, that is, when the charging of the parasitic capacitance is completed.

Figure 4:
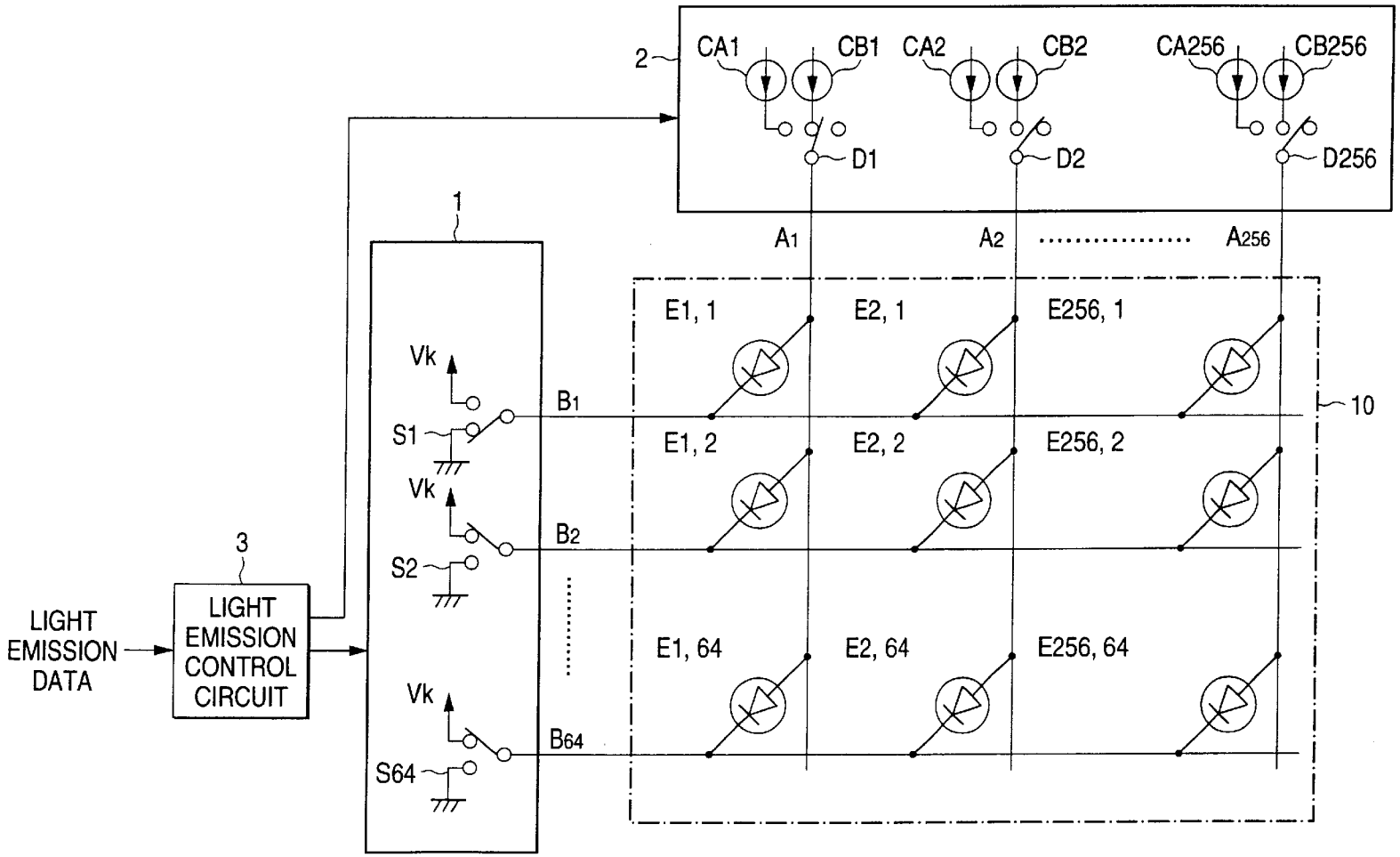
FIG. 4 is a block diagram of a light emitting display panel driving device used in a method of driving a light emitting element according to a second embodiment of the present invention.
Figure 5A:
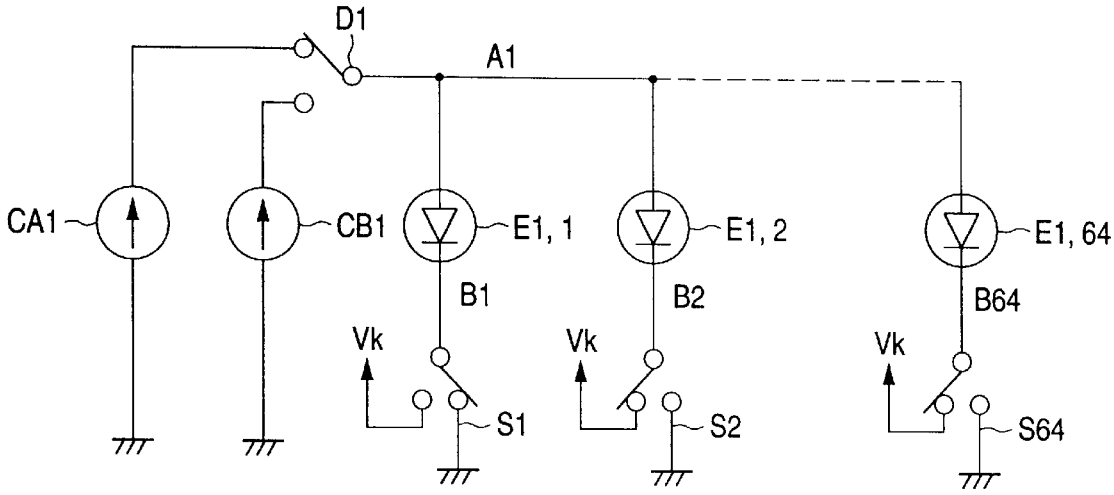
FIGS. 5A and 5B are partial circuit diagrams when anode line A1 is driven by the method of the second embodiment.
Figure 5B:
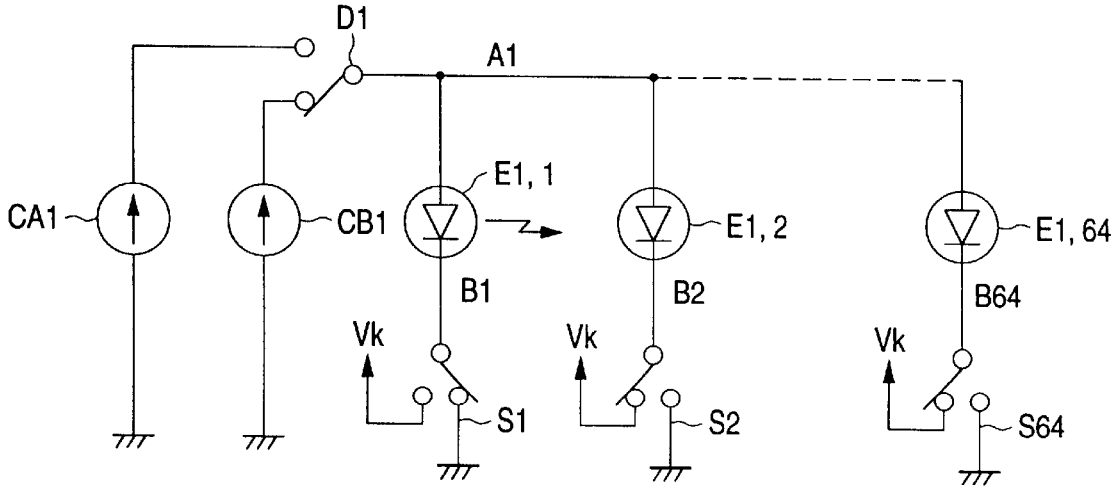
Figure 6:
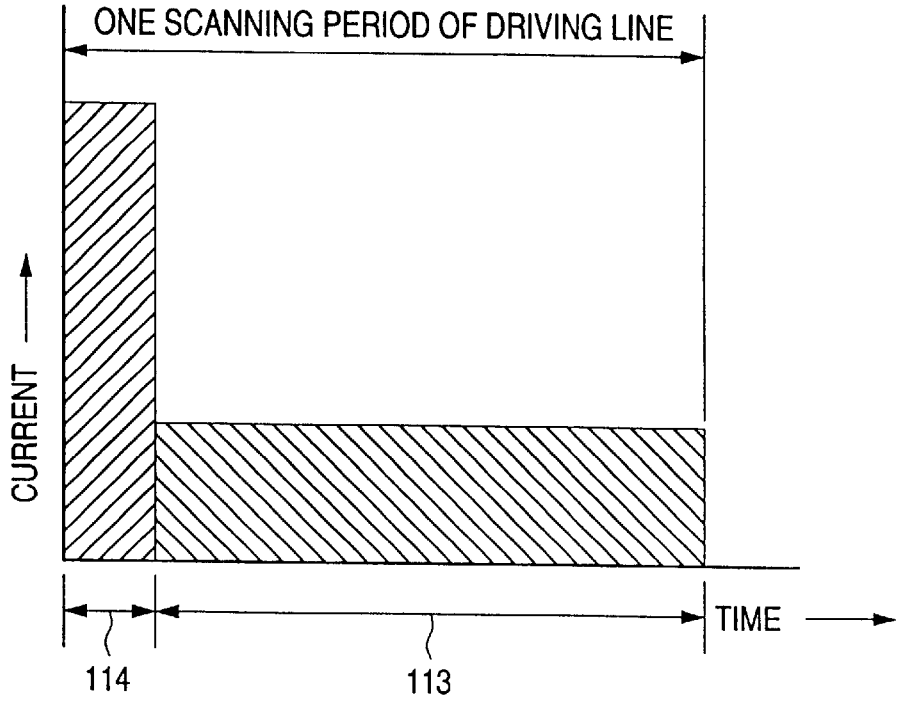
FIG. 6 is a graph showing a relationship between a supplied current and timings of connection exchanges between a first constant voltage source and a second voltage source by an anode line driving circuit.
Figure 7:
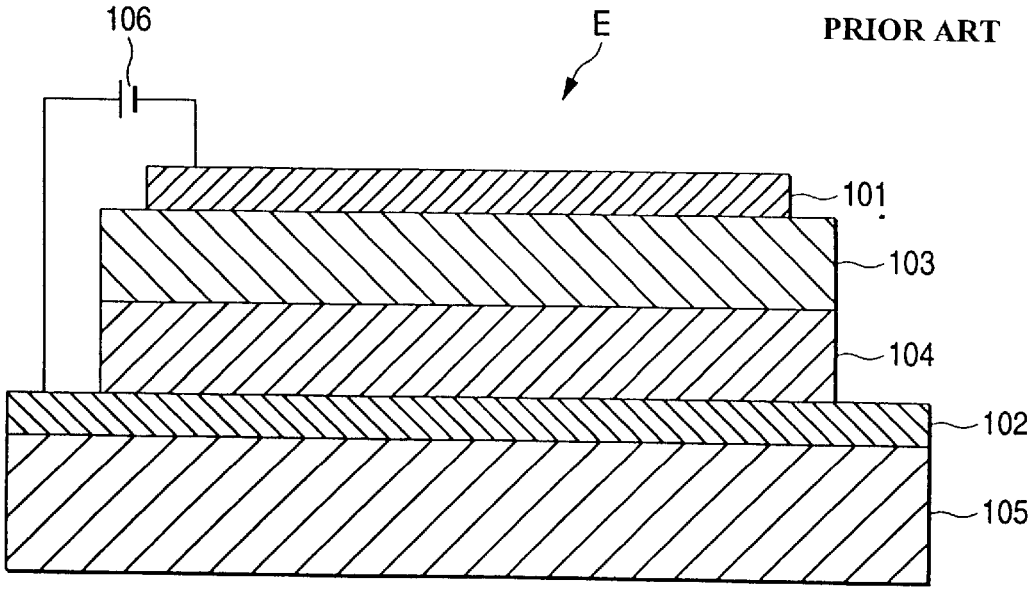
FIG. 7 is a sectional view showing a related organic electroluminescent light emitting element.
Figure 8:
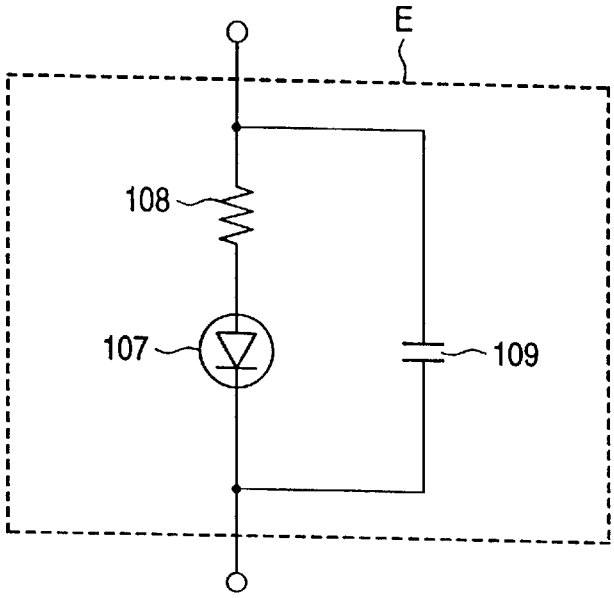
FIG. 8 PRIOR ART
FIG. 8 is an electric equivalent circuit diagram of the light emitting element of FIG. 7.
Figure 9:
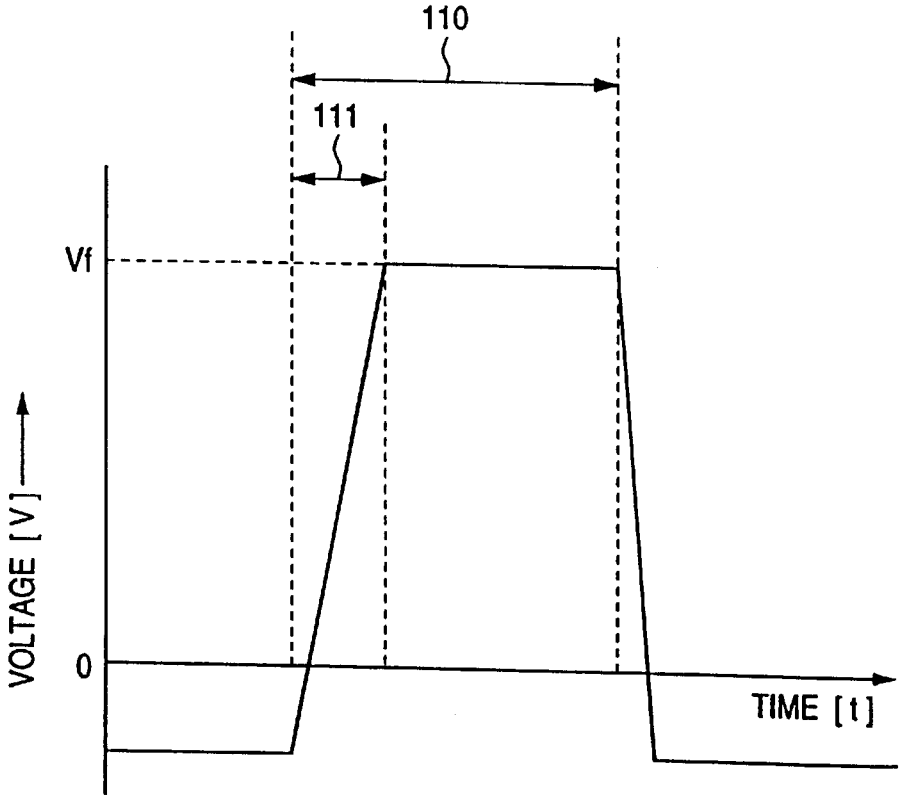
FIG. 9 PRIOR ART
FIG. 9 is a graph showing the voltage waveform before and after the light emitting element of FIG. 7 is scanned using an AC driving technique.

Referring now to FIGS. 4 to 6, an explanation will be given of the second embodiment of the present invention.

The second embodiment is different from the first embodiment only in that constant current sources are used in place of the constant voltage sources V1 to V256 (i.e., the first driving sources) of the first embodiment. That is, as in the first embodiment, the first contact points of the switches D1 to D256 of the anode line driving circuit 2 are open, and the second contact points thereof are connected to the second constant current sources CB1 to CB256, respectively. However, different from the first embodiment, the third contact points of the switches D1 to D256 are connected to the first constant current sources CA1 to CA256, respectively.

The first constant current sources CA1 to CA256 can supply a current larger than that of the second constant current sources CB1 to CB256. Like the constant voltage sources V1 to V256 in the first embodiment, these first constant current sources CA1 to CA256 serve as chargers of the light emitting elements.

Referring to FIGS. 4, 5A and 5B, an explanation will be given of the operation of the second embodiment of the present invention. FIGS. 5A and 5B each show a partial circuit diagram relative to the anode line A1 of FIG. 4.

FIGS. 5A and 5B show the state in which the light emitting element E1, 1 is caused to emit light in such a manner that the cathode line B1 is scanned and the anode line A1 is driven. In this state, the cathode line B1 is connected to ground potential, and the other cathode lines are connected to the reverse bias voltage Vk.

During the scanning period of the cathode line B1, the anode line A1 is first driven by being connected to the first constant current source CA1 (see FIG. 5*a*), and its connection is subsequently switched by the driving switch D1 to the second constant current source CB1 (see FIG. 5B). During this scanning period of cathode line B1, the other cathode lines are not driven because they are connected to the reverse bias voltage Vk.

When scanning of the cathode line B1 is completed, scanning is shifted to the cathode line B2 in accordance with the light emission control signal from the light emission control circuit 3. Scanning will be sequentially executed for the scanning lines.

In the above operation, the light emitting element E1, 1 is connected to the first constant current source CA1 at the moment the scanning period of the cathode B1 begins. The charging of its parasitic capacitance is swift, so that the voltage across the light emitting element E1, 1 can be swiftly made equal to the voltage when the light emitting element E1, 1 emits light with the maximum instantaneous brightness. This assures a longer period of time during which the light emitting element E1, 1 emits light with the maximum instantaneous brightness during the scanning period, thereby providing improved light-emitting brightness during the scanning period.

After the parasitic capacitance is charged, the connection is changed from the first constant current source CA1 to the second constant current source CB1, with little change in brightness.

FIG. 6 is a graph showing the relationship between the supplied current and the timing of connection exchange from the first constant current source to the second constant current source by the anode line driving circuit 2. The ordinate indicates a current value supplied to a light emitting element E, whereas the abscissa indicates timing of connection exchange from the first constant source to the second constant current source.

Reference numeral 114 denotes a period during which the first constant current source is connected to the light emitting element. Reference numeral 113 denotes the period during which the second constant current source is connected to the light emitting element.

The connection is most preferably exchanged from the first constant current source to the second constant current source immediately after the charging of the parasitic capacitance of the light emitting element is completed. Using this timing as a guide, the period 114 during which the first constant current source is connected should be determined.

The embodiments as described above are most effective when used in a device for linearly and sequentially driving a display panel having light emitting elements arranged in a matrix.

In previous matrix displays, in order to apply the voltage across the light emitting element so as to emit light with the maximum instantaneous brightness, the potential of the anode line connected to the light emitting element had to be set to a predetermined value. However, since the anode line was also connected to the light emitting elements not emitting light (i.e., the elements on the cathode line not scanned), in order to place the anode line at the predetermined potential, the parasitic capacitance of the other light emitting elements had to be slightly charged. Thus, the current to be used for charging the light emitting element that is to emit light became insufficient.

The present invention is an improvement over the previous matrix displays in that when the anode line is connected to a charger such as a constant voltage source, its potential can be instantaneously set to a predetermined value. This permits the light emitting element at issue to be charged at a high speed inclusive of the other light emitting elements that do not emit light.

The present invention is most effectively used for the matrix display subjected to linear sequential driving. However, the present invention is not limited to the matrix display, but may be applied to a general light emitting display using known capacitive light emitting elements.

As described above, in the light emitting display device and its driving method of the present invention, the period elapsing until a light emitting element can emit light with desired instantaneous brightness can be shortened and a variation in the instantaneous brightness during the scanning period can be reduced. Thus, a light emitting display device, which provides a clear image having high brightness, can be realized.

While only certain embodiments of the invention have been specifically described herein, it will be apparent that numerous modifications may be made thereto without departing from the spirit and scope of the invention.

The entire disclosure of each and every foreign patent application from which the benefit of foreign priority has been claimed in the present application is incorporated herein by reference, as if fully set forth.

What is claimed is:

1. A light emitting display device having a plurality of light emitting elements, comprising:

first and second driving sources that are connectable to the light emitting elements;

a connection selector for selecting one of said first and said second driving sources, and connecting the selected driving source to the light emitting elements; and a controller for controlling said connection selector to connect said first driving source to the light emitting elements, and subsequently, in exchange for said first driving source, connect said second driving source to the light emitting elements, wherein said first driving source is a constant voltage source, and said second driving source is a constant current source, and wherein said controller controls said connection selector to sequentially connect said first driving source and said second driving source to at least one selected element of said light emitting elements during a scanning period during which said selected element emits light.

2. The light emitting display device according to claim 1, wherein a driving signal supplied by said second driving source causes said selected element to emit light during said scanning period.

3. A light emitting display device having a plurality of light emitting elements, comprising:

first and second driving sources that are connectable to the light emitting elements;

a connection selector for selecting one of said first and said second driving sources, and connecting the selected driving source to the light emitting elements; and a controller for controlling said connection selector to connect said first driving source to the light emitting elements, and subsequently, in exchange for said first driving source, connect said second driving source to the light emitting elements;

wherein each of said first and said second driving sources is a constant current source, and wherein said controller controls said connection selector to sequentially connect said first driving source and said second driving source to at least one selected element of said light emitting elements during a scanning period during which said selected element emits light.

4. The light emitting display device according to claim 3, wherein a driving signal supplied by said second driving source causes said selected element to emit light during said scanning period.

5. A light emitting display device having a plurality of light emitting elements, comprising:

a driving source;

a charger for charging the parasitic capacitance of each of the light emitting elements; and a selector for selecting one of said driving source and said charger, and connecting the selected one to the light emitting elements, wherein said charger and said driving source are connected to at least one selected element of said light emitting elements during a scanning period during which said selected element emits light.

6. The light emitting display device according to claim 5, wherein a driving signal supplied by said driving source causes said selected element to emit light during said scanning period.

7. A light emitting display device having a plurality of light emitting elements, comprising:

a constant voltage driving source that is connectable to the light emitting elements; and a constant current driving source that is connectable to the light emitting elements;

wherein said constant voltage driving source is first connected to the light emitting elements, and the constant current driving source is subsequently, and in exchange for said constant voltage driving source, connected to the light emitting elements, and wherein said constant voltage driving source and said constant current driving source are connected to at least one selected element of said light emitting elements during a scanning period during which said selected element emits light.

8. The light emitting display device according to claim 7, wherein a driving signal supplied by said constant current driving source causes said selected element to emit light during said scanning period.

9. A light emitting display device having a plurality of light emitting elements, comprising:

a first constant current driving source that is connectable to the light emitting elements; and a second constant current driving source that is connectable to the light emitting elements;

wherein said first constant current driving source is first connected to the light emitting elements, and the second constant current driving source is subsequently, and in exchange for said first constant current driving source, connected to the light emitting elements, and wherein said first constant current driving source and said second constant current driving source are connected to at least one selected element of said light emitting elements during a scanning period during which said selected element emits light.

10. The light emitting display device according to claim 9, wherein a driving signal supplied by said second constant current driving source causes said selected element to emit light during said scanning period.

11. A method for driving a light emitting display device having a plurality of light emitting elements, comprising the steps of:

providing a driving source that is connectable to the light emitting elements;

providing a charger for charging a parasitic capacitance of each of the light emitting elements;

connecting, firstly, said charger to the light emitting elements; and connecting, subsequently and in exchange for said charger, said driving source to the light emitting elements, wherein said charger and said driving source are connected to at least one selected element of said light emitting elements during a scanning period during which said selected element emits light.

12. The method according to claim 11, wherein a driving signal supplied by said driving source causes said selected element to emit light during said scanning period.

13. A method for driving a light emitting display device having light emitting elements connected to intersecting points of a plurality of anode lines and cathode lines arranged in a matrix, either one of said anode lines and said cathode lines are used as scanning lines while the others are used as driving lines, and while one of the scanning lines is scanned during a scanning period, a driving source is synchronously connected to one of the driving lines so that a light emitting element connected to an intersecting point of the one scanning line and the one driving line is caused to emit light, wherein immediately after the scanning period of the one scanning line is started, a first driving source is connected to the one driving line, and subsequently, in exchange for the first driving source, a second driving source is connected to the one driving line, and wherein said first driving source and said second driving source are connected to said light emitting element connected to said intersecting point during said scanning period.

14. The method according to claim 13, wherein a driving signal supplied by said second driving source causes said light emitting element connected to said intersecting point to emit light during said scanning period.

15. A method for driving a light emitting display device having light emitting elements connected to intersecting points of a plurality of anode lines and cathode lines arranged in a matrix, either one of said anode lines and said cathode lines are used as scanning lines while the others are used as driving lines, and while one of the scanning lines is scanned during a scanning period, a driving source is synchronously connected to one of the driving lines so that a light emitting element connected to an intersecting point of the one scanning line and the one driving line is caused to emit light;

wherein immediately after the scanning period of the one scanning line is started, a charger is connected to the one driving line and subsequently, in exchange for said charger, a driving source is connected to the one driving line, and wherein said charger and said driving source are connected to said light emitting element connected to said intersecting point during said scanning period.

16. The method according to claim 15, wherein a driving signal supplied by said driving source causes said light emitting element connected to said intersecting point to emit light during said scanning period.

17. A display device, comprising:

a plurality of driving lines and scanning lines arranged in a matrix, wherein a selected scanning line of said scanning lines is scanned during a selected scanning period; and a plurality of light emitting elements respectively connected at intersections of said driving lines and said scanning lines, wherein a selected intersection is located at an intersection of a selected driving line of said plurality of driving lines and said selected scanning line, wherein a selected light emitting element of said light emitting elements is located at said selected intersection and emits light during said selected scanning period, and wherein a first driving signal is supplied to said selected driving line during said selected scanning period and a second driving signal is subsequently supplied to said selected driving line during said selected scanning period, and wherein a value of said first driving signal is different than a value of said second driving signal.

18. The display device according to claim 17, wherein said first driving signal and said second driving signal cause said selected light emitting element to emit light during said selected scanning period.

19. A method of driving a display device, comprising:

supplying a first driving signal to a selected driving line of said display device during a selected scanning period, wherein said selected driving line is one of a plurality of driving lines of said display device, and wherein said selected scanning period is a period during which a selected scanning line of a plurality of scanning lines of said display device is scanned; and after supplying said first driving signal, supplying a second driving signal to said selected driving line during said selected scanning period, wherein a value of said first driving signal is different than a value of said second driving signal.

20. The method according to claim 19, wherein said first driving signal and said second driving signal cause a selected light emitting element to emit light during said selected scanning period, wherein said selected light emitting element is located at an intersection of said selected scanning line and said selected driving line.

* * * * *